US007214086B1

(12) United States Patent
Hsieh

(10) Patent No.: US 7,214,086 B1
(45) Date of Patent: May 8, 2007

(54) LARGE CURRENT CONNECTOR

(76) Inventor: Yu-Chu Hsieh, 3F, No.28, Alley22, Lane101, Xinghua St., Pingzhen City Taoyuan County (TW)

( * ) Notice: Subject to any disclaimer, the term of this patent is extended or adjusted under 35 U.S.C. 154(b) by 0 days.

(21) Appl. No.: 11/367,584

(22) Filed: Mar. 6, 2006

(51) Int. Cl.
*H01R 13/627* (2006.01)

(52) U.S. Cl. ..... 439/352; 439/680; 439/607; 439/489

(58) Field of Classification Search ..... 439/352, 439/680, 607, 489
See application file for complete search history.

(56) References Cited

U.S. PATENT DOCUMENTS 6,254,424 B1 * 7/2001 Murakami et al. ..... 439/489
6,287,139 B1 * 9/2001 Seko et al. ..... 439/489
6,527,579 B2 * 3/2003 Sato et al. ..... 439/382

* cited by examiner

*Primary Examiner*—Truc Nguyen
(74) *Attorney, Agent, or Firm*—Birch, Stewart, Kolasch & Birch, LLP

(57) ABSTRACT

A large current connector consists of a male plug and a female socket. The male plug includes a shell, a coupling member, a first upper metal plate and a first lower metal plate. The female socket includes a sleeve, an insulation member, a second upper metal plate and a second lower metal plate. The sleeve has latch cavities on two sides corresponding to and engageable with elastic latch elements on two sides of the shell. Thus the male plug and the female socket can be coupled together rapidly. The insulation member anchors the metal plates of the male plug and the female socket to prevent loosening thereof. Deformation of the metal plates also can be prevented to avoid short circuit.

7 Claims, 3 Drawing Sheets

LARGE CURRENT CONNECTOR

FIELD OF THE INVENTION

The present invention relates to a large current connector and particularly to a connector which includes a male plug and a female socket that can be coupled together rapidly in a latch manner and an insulation member to anchor upper and lower metal plates wedged in the male plug and the female socket to prevent loosening and short circuit caused by deformation.

BACKGROUND OF THE INVENTION

Innovations of the peripherals and accessories of electric appliances progress constantly. Among them the connector elements consisting of a male plug and a female socket are widely used. They can be assembled and coupled together easily. However there are still room for improvement especially on enhancing the connectivity and simplifying assembly and coupling.

Coupling of the male plug and the female socket of the conventional connector generally adopts screwing elements. In practice, the screwing elements tend to loosen when subject to external forces. Moreover, if screwing holes have a slight deviation on the tolerance, the male plug and the female socket cannot be fastened securely. Not only saving time on assembly and coupling cannot be achieved, electric conductivity also could be affected.

SUMMARY OF THE INVENTION

Therefore the primary object of the present invention is to provide a large current connector to solve the problem of the conventional male plug and the female socket that easily loosen due to impact of external forces. The invention provides a male plug and a female socket that can be latched together quickly, and an insulation member to anchor metals plates wedged in the male plug and the female socket to prevent loosening and short circuit caused by deformation.

To achieve the foregoing object, the large current connector of the invention includes a male plug and a female socket. The male plug has a shell, a coupling member, a first upper metal plate and a first lower metal plate. The female socket has a sleeve, an insulation member, a second upper metal plate and a second lower metal plate. The sleeve has latch cavities on two sides corresponding to elastic latch elements on two sides of the shell so that they can be coupled together easily.

By means of the structure set forth above, significant benefits can be achieved, notably:

1. The male plug and the female socket can be made in a smaller size. A planar contact is formed that can minimize contact resistance. Hence it can channel a larger current and also facilitate installation and fastening.

2. The shell of the male plug has the elastic latch elements on two sides of a coupling end to form a secure engagement with the latch cavities of the female socket. Loosening can be avoided.

3. The first upper and lower metal plates wedged in the male plug is formed with an arched angle on a wedge end to facilitate insertion of the metal plates into the latch trough of the shell and coupling member to form a firm anchoring. Therefore short circuit caused by deformation of the upper and lower metal plates due to external factors or other reasons can be prevented.

4. The insulation member in the female socket separates and anchor the second upper and lower metal plates. Hence deformation and short circuit can be prevented.

5. After the male plug and the female socket are coupled, the insulation member can enhance the connectivity to prevent loosening of the male plug and the female socket.

6. The shell of the male plug is formed with trapezoidal surfaces to facilitate finger depressing. The end surfaces have anti-slip transverse traces or ridges to make plugging and unplugging easier.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
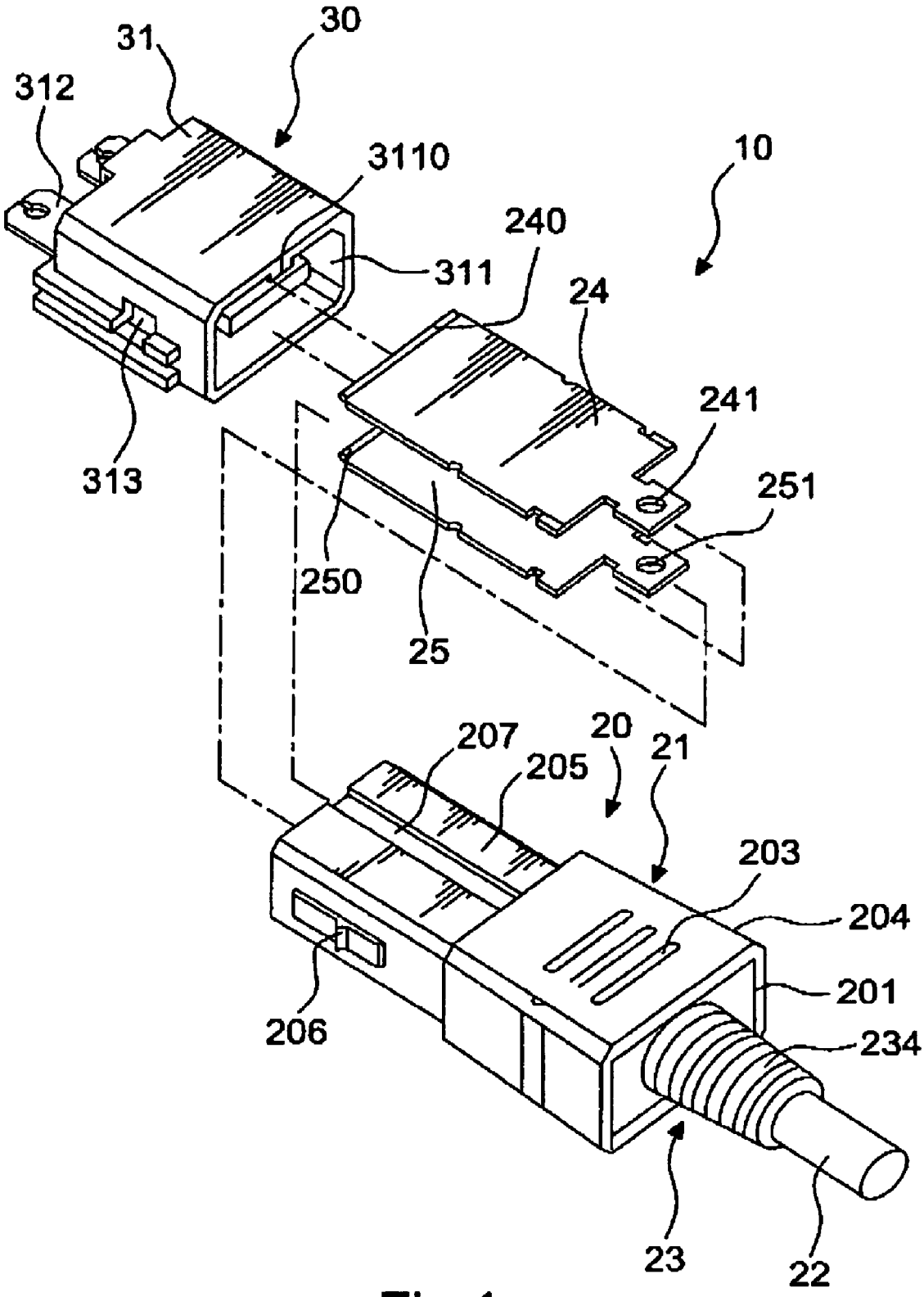
FIG. 1 is an exploded view of the present invention.
Figure 3:
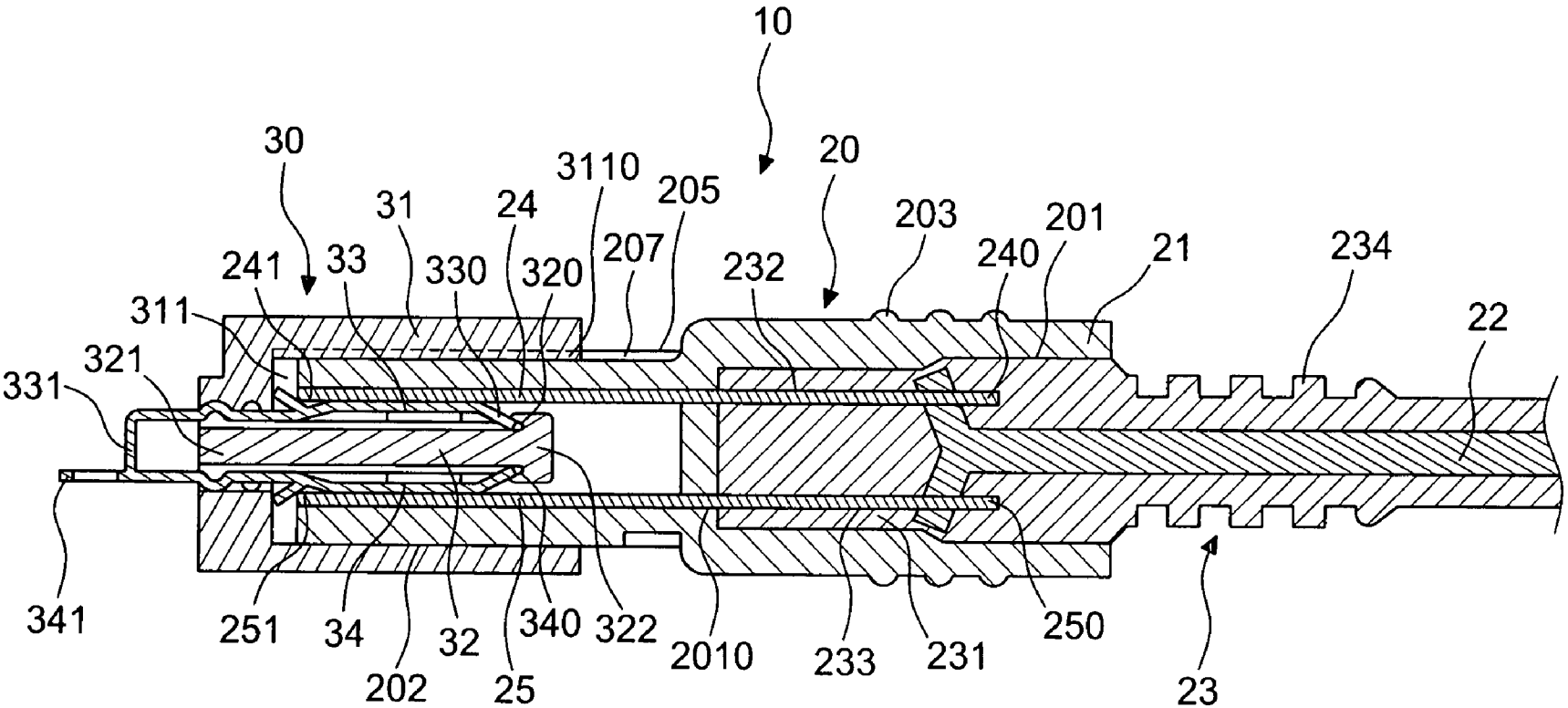
FIG. 3 is a sectional view of the present invention.

Please referring to FIGS. 1 and 3, the large current connector 10 according to the invention includes a male plug 20 and a female socket 30.

The male plug 20 includes a shell 21, a coupling member 23, a first upper metal plate 24 and a first lower metal plate 25. The shell 21 has two ends formed respectively a hollow body 201 and 202 that are interposed by latch troughs 2010. One end has a trapezoidal surface 204 with anti-slip transverse traces 203 (or ridges) formed thereon. Another end forms a coupling end 205 which has elastic latch elements 206 on two sides and a flute 207 on another side. The coupling member 23 has a latch end 231 on one end that mates the hollow body 201 of the shell 21 and has latch flutes 232 and 233 on a upper end and a lower end, and a first connection end 234 on another end to be run through by a core 22. The first upper and lower metal plates 24 and 25 run through the latch troughs 2010 and are wedged in the latch flutes 232 and 233, and have one end formed respectively a wedge end 240 and 250 with an arched angle and another end to become an insertion hole end 241 and 251.

The female socket 30 includes a sleeve 31, an insulation member 32, a second upper metal plate 33 and a second lower metal plate 34 (referring to FIG. 3). The sleeve 31 is hollow and has a coupling cavity 311 on one end and a latch member 3110 on a upper side of the cavity 311 mating the flute 207 of the coupling end 205, and a second connection end 312 on another end, and two latch cavities 313 on two sides engageable with the elastic latch elements 206 of the coupling end 205. The insulation member 32 is located in the coupling cavity 311 and has two coupling troughs 320 on two sides and a contact end 321 on one end and an insertion end 322 on another end close to the coupling troughs 320. The second upper and lower metal plates 33 and 34 are wedged in the coupling troughs 320 of the insulation member 32, and have a wedge end 330 and 340 on one end and a connection hole end 331 and 341 on another end.

The elastic latch elements 206 of the coupling end 205 of the male plug 20 can be wedged in the latch cavities 313 of the female socket 30 to form a secure coupling without loosening off.

The arched angle (not shown in the drawings) on the wedge ends 240 and 250 of the first upper and lower metal plates 24 and 25 make insertion of the first metal plates 24 and 25 into the latch troughs 2010 easier, and allow the first metal plates 24 and 25 to be wedged in the latch flutes 232 and 233 to form a secured anchoring without deforming and short circuit due to external or other factors.

Referring to FIG. 3, the first and second metal plates 24, 25, 33 and 34 in the male plug 20 and female socket 30 are isolated and anchored by the insulation member 32. The connectivity can be enhanced, and short circuit caused by deformation can be prevented. Loosening of the male plug 20 and female socket 30 also can be avoided.

In addition, the anti-slip transverse traces 204 or ridges on the trapezoidal surface 204 of the shell 21 make plugging and unplugging easier.

Figure 2:
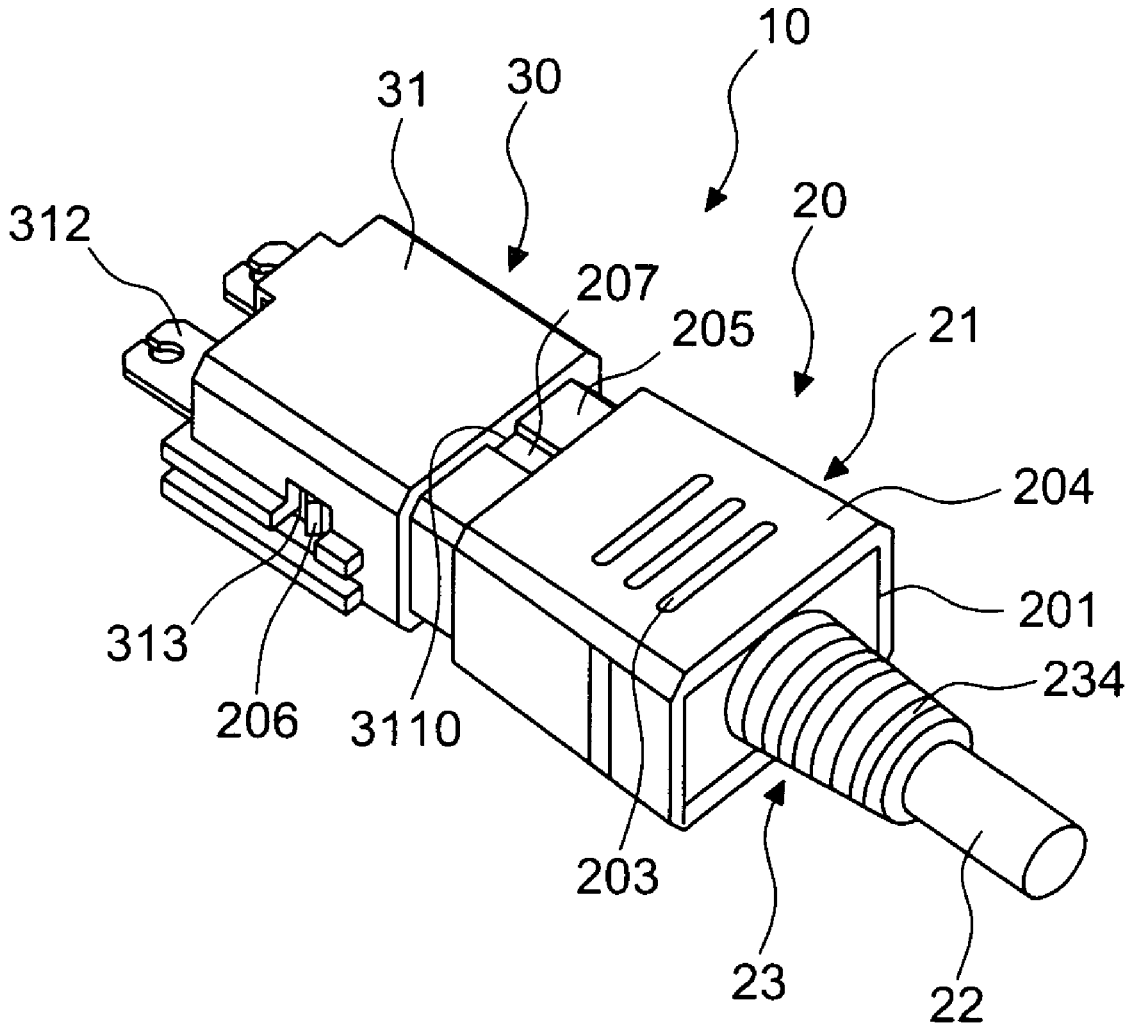
FIG. 2 is a perspective view of the present invention.

Referring to FIGS. 2 and 3, the flute 207 on the coupling end 205 of the male plug 20 is aligned with the latch member 3110 of the female socket 30, thus the hollow body 202 of the male plug 21 can be coupled with the insulation member 32 that has the second upper and lower metal plates 33 and 34 wedged thereon; the elastic latch elements 206 of the shell 21 can directly latch in the latch cavities 313 of the sleeve 31 to form a rapid coupling of the male plug 20 and the female socket 30. As the metal plates 24, 25, 33 and 24 are anchored on the insulation member 32, deformation can be prevented, and short circuit can be avoided, and loosening of the male plug 20 and female socket 30 also can be prevented. Connectivity can be enhanced, fabrication and assembly of the large current connector 10 is easier, and production time can be reduced.

In short, the large current connector 10 of the invention has the following main features: the male plug 20 and the female socket 30 are coupled rapidly in a latch manner, the insulation member 32 can anchor the upper and lower metals plates 24, 25, 33 and 34 to prevent loosening and short circuit caused by deformation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A large current connector, comprising:

a male plug including a shell, a coupling member, a first upper metal plate and a first lower metal plate, the shell having hollow bodies on two ends that are interposed by latch troughs, one end having a trapezoidal surface and other end forming a coupling end which has two elastic latch elements on two sides, the coupling member having a latch end which mates with one hollow body, the first upper metal plate and the first lower metal plate running through the latch troughs and being anchored on the coupling member, and having respectively a wedge end on one end forming an arched angle and an insertion hole end on another end; and a female socket including a sleeve, an insulation member, a second upper metal plate and a second lower metal plate, the sleeve being hollow and having a coupling cavity on one end and a second connection end on another end, and latch cavities on two sides, the insulation member being located in the coupling cavity and having coupling troughs on two sides to be wedged by the second upper metal plate and the second lower metal plate.

2. The large current connector of claim 1, wherein the trapezoidal surface has anti-slip traces formed thereon.

3. The large current connector of claim 1, wherein the trapezoidal surface has ridges formed thereon.

4. The large current connector of claim 1, wherein the coupling member has a latch end on one end mating one hollow body of the shell and a first connection end on another end.

5. The large current connector of claim 1, wherein the insulation member has a contact end on one end and an insertion end on another end.

6. The large current connector of claim 1, wherein the second upper metal plate and the second lower metal plate have respectively a wedge end on one end and a connection hole end on another end.

7. The large current connector of claim 4, wherein the latch end has latch flutes on a upper end and a lower end.

* * * * *